US011462228B2

(12) United States Patent
Araki et al.

(10) Patent No.: US 11,462,228 B2
(45) Date of Patent: Oct. 4, 2022

(54) SPEECH INTELLIGIBILITY CALCULATING METHOD, SPEECH INTELLIGIBILITY CALCULATING APPARATUS, AND SPEECH INTELLIGIBILITY CALCULATING PROGRAM

(71) Applicants: NIPPON TELEGRAPH AND TELEPHONE CORPORATION, Tokyo (JP); Wakayama University, Wakayama (JP)

(72) Inventors: Shoko Araki, Kyoto (JP); Tomohiro Nakatani, Kyoto (JP); Keisuke Kinoshita, Kyoto (JP); Toshio Irino, Wakayama (JP); Toshie Matsui, Wakayama (JP); Katsuhiko Yamamoto, Wakayama (JP)

(73) Assignees: NIPPON TELEGRAPH AND TELEPHONE CORPORATION, Tokyo (JP); WAKAYAMA UNIVERSITY, Wakayama (JP)

( * ) Notice: Subject to any disclaimer, the term of this patent is extended or adjusted under 35 U.S.C. 154(b) by 200 days.

(21) Appl. No.: 16/636,032

(22) PCT Filed: Aug. 3, 2018

(86) PCT No.: PCT/JP2018/029317
§ 371 (c)(1),
(2) Date: Feb. 3, 2020

(87) PCT Pub. No.: WO2019/027053
PCT Pub. Date: Feb. 7, 2019

(65) Prior Publication Data

US 2021/0375300 A1 Dec. 2, 2021

(30) Foreign Application Priority Data

Aug. 4, 2017 (JP) ..... JP2017-151370

(51) Int. Cl.
*G10L 21/0232* (2013.01)
*G10L 21/0364* (2013.01)
*G10L 25/60* (2013.01)

(52) U.S. Cl.
CPC ..... *G10L 21/0232* (2013.01); *G10L 21/0364* (2013.01); *G10L 25/60* (2013.01)

(58) Field of Classification Search
CPC . G10L 21/0232; G10L 21/0364; G10L 25/60; G10L 21/0264; G10L 21/0308; G10L 21/0332; G10L 2021/065
See application file for complete search history.

(56) References Cited

U.S. PATENT DOCUMENTS 8,098,859 B2 * 1/2012 Zeng ..... H04R 25/353 607/57
9,842,607 B2 * 12/2017 Shiga ..... G10L 19/0204
(Continued)

OTHER PUBLICATIONS

T. Irino and R. D. Patterson, "Dynamic, Compressive Gammachirp Auditory Filterbank for Perceptual Signal Processing," 2006 IEEE International Conference on Acoustics Speech and Signal Processing Proceedings, 2006, pp. V-V, doi: 10.1109/ICASSP.2006.1661230. (Year: 2006).*
(Continued)

*Primary Examiner* — Bhavesh M Mehta
*Assistant Examiner* — Nandini Subramani
(74) *Attorney, Agent, or Firm* — Xsensus LLP

(57) ABSTRACT

A speech intelligibility calculating method is a method executed by a speech intelligibility calculating apparatus, the speech intelligibility calculating method including: a speech intelligibility calculating step of calculating a speech intelligibility that is an objective assessment index of a speech quality, based on a difference component between features found through an analysis of an input clean speech and an input enhanced speech, using one or more filter
(Continued)

banks; and a step of outputting the speech intelligibility calculated at the speech intelligibility calculating step. This speech intelligibility calculating method is capable of calculating a speech intelligibility without any dependency on a speech enhancement method.

14 Claims, 8 Drawing Sheets

(56) References Cited

U.S. PATENT DOCUMENTS

| | | | | |
|---|---|---|---|---|
| 10,057,693 | B2 * | 8/2018 | Andersen | G10L 25/60 |
| 2014/0126728 | A1 | 5/2014 | Van Der Schaar et al. | |

OTHER PUBLICATIONS

Jenstad, Lorienne M., and Pamela E. Souza. "Quantifying the effect of compression hearing aid release time on speech acoustics and intelligibility." Journal of Speech, Language, and Hearing Research (2005) (Year: 2005).*

T. Irino, et al. , "Dynamic, Compressive Gammachirp Auditory Filterbank for Perceptual Signal Processing," 2006 IEEE International Conference on Acoustics Speech and Signal Processing Proceedings, 2006, pp. V-V (Year: 2006).*

C. H. Taal, et al. , "An Algorithm for Intelligibility Prediction of Time-Frequency Weighted Noisy Speech," in IEEE Transactions on Audio, Speech, and Language Processing, vol. 19, No. 7, pp. 2125-2136, Sep. 2011 (Year: 2011).*

Katsuhito Yamamoto, et al. "Predicting Speech Intelligibility based on the Gammachirp Envelope Distortion Index under Bubble Noise Conditions," 2018 Spring Meeting Acoustical Society of Japan Nippon Institute of Technology, Saitama, Mar. 13-15, 2018, with English translation of introduction, 11 pages.

International Search Report and Written Opinion dated Oct. 2, 2018 for PCT/JP2018/029317 filed on Aug. 3, 2018, 9 pages including English Translation of the International Search Report.

Hambley, A.R., "Electrical Engineering: Principles and Applications (4th Edition)," Pearson Education, Inc., 2008, 29 pages.

Jorgensen, S., and Dau, T., "Predicting speech intelligibility based on the signal-to-noise envelope power ratio after modulation-frequency selective processing," The Journal of the Acoustical Society of America, vol. 130, No. 3, Sep. 2011, pp. 1475-1487.

Taal, C.H., et al., "A short-time objective intelligibility measure for time-frequency weighted noisy speech," IEEE International Conference on Acoustics, Speech and Signal Processing, IEEE, Mar. 14, 2010, pp. 4214-4217.

Yamamoto, K., et al., "Examination of a method for predicting speech intelligibility dcGC-sEPSM: Characteristics of evaluation noise and effect on prediction accuracy," Proceedings of the 2016 Autumn Meeting of Acoustical Society of Japan, Sep. 2016, pp. 663-666.

Yamamoto, K., et al., "Speech intelligibility prediction based on the envelope power spectrum model with the dynamic compressive gammachirp auditory filterbank," Interspeech 2016, San Francisco, USA, Sep. 8-12, 2016, pp. 2885-2889.

* cited by examiner

SPEECH INTELLIGIBILITY CALCULATING METHOD, SPEECH INTELLIGIBILITY CALCULATING APPARATUS, AND SPEECH INTELLIGIBILITY CALCULATING PROGRAM

CROSS-REFERENCE TO RELATED APPLICATIONS

The present application is based on PCT filing PCT/JP2018/029317, filed Aug. 3, 2018, which claims priority to JP 2017-151370, filed Aug. 4, 2017, the entire contents of each are incorporated herein by reference.

FIELD

The present invention relates to a speech intelligibility calculating method, a speech intelligibility calculating apparatus, and a speech intelligibility calculating program.

BACKGROUND

A speech intelligibility or an objective speech-quality assessment index is essential for the future development of a speech enhancement or noise-reduction signal processing, and making improvements in these types of processing. In other words, there has been a demand for obtaining a speech intelligibility, which is one example of the objective speech-quality assessment index, for the purpose of making an assessment and an improvement of the speech enhancement processing, such as noise reduction processing.

Addressing this issue, conventionally, a speech-based envelope power spectrum model (sEPSM) has been disclosed (see Non Patent Literature 1, for example). FIG. 8 is a schematic illustrating the framework of a conventional speech intelligibility prediction. Hereinafter, it is assumed that, for a signal A, the indication "ˆA" is equivalent to the symbol "ˆ" appended immediately above "A", and for the signal A, the indication "~A" is equivalent to the symbol "~" appended immediately above "A".

As illustrated in FIG. 8, conventionally, a speech intelligibility calculating apparatus 12P using the sEPSM receives inputs of an enhanced speech (ˆS) and a residual noise (~N) from an enhancement processing apparatus 11P. The enhancement processing apparatus 11P positioned at the preceding stage applies enhancement processing to a noisy speech (S+N) that is resultant of adding a noise (N) to a clean speech (S), and also applies the enhancement processing to the noise (N). In other words, the enhancement processing apparatus 11P is configured to output an enhanced speech (ˆS) from the noisy speech (S+N), and to estimate a residual noise (~N) included in the enhanced speech (ˆS). The speech intelligibility calculating apparatus 12P positioned at the subsequent stage receives the enhanced speech (ˆS) and the residual noise (~N) output from the enhancement processing apparatus 11P, and predicts an intelligibility of the speech applied with non-linear speech enhancement processing, using a combination of a gammatone (GT) auditory filter bank, which is a mathematical model of a peripheral auditory system, and a modulation filter bank.

Also having been disclosed conventionally is dcGC-sEPSM that uses the dynamic compressive gammachirp filter bank (dcGC) capable of dynamically reflecting non-linear features of auditory filters, instead of the gammatone auditory filter bank used in the sEPSM (see Non Patent Literatures 2 and 3, for example). With this technology, it has become possible to reflect the features of hearing-impaired persons.

CITATION LIST

Patent Literature

Non Patent Literature 1: S. Jorgensen, and T. Dau, "Predicting speech intelligibility based on the signal-to-noise envelope power ratio after modulation-frequency selective processing", J. Acoust. Soc. Am., 130(3), pp. 1475-1487, 2011.

Non Patent Literature 2: K. Yamamoto, T. Irino, T. Matsui, S. Araki, K. Kinoshita, and T. Nakatani, "Speech intelligibility prediction based on the envelope power spectrum model with the dynamic compressive gammachirp auditory filterbank", in Proceedings of Interspeech 2016, pp. 2885-2889, 2016.

Non Patent Literature 3: Katsuhiko Yamamoto, Toshio Irino, Toshie Matsui, Shoko Araki, Kinoshita Keisuke, and Tomohiro Nakatani, "ONSEI MEIRYOU-DO YOSOKU HOU dcGC-sEPSM NO SYOKENTOU: HYOUKA-YOU ZATSUON NO TOKUSEI TO YOSOKU SEIDO E NO EIKYOU", Acoustical Society of Japan: KENKYU HAPPYOUKAI KOEN RONBUN SYU, 2-P-44, pp. 663-666, 2016.

SUMMARY

Technical Problem

The sEPSM uses a residual noise component (the residual noise (~N) illustrated in FIG. 8) as an input signal. However, conventionally, a clear definition of the residual component has not been necessarily available, and it has also been necessary to determine a residual component that is appropriate for the assessment, depending on the technique used for the speech enhancement processing. Therefore, the sEPSM has been only capable of estimating an intelligibility for the speech enhancement techniques capable of estimating both of the enhanced speech and the residual noise component, and hence, the applicable scope of the sEPSM has been limited.

Furthermore, because the sEPSM uses linear time-invariant filters for the gammatone auditory filter bank, the sEPSM is incapable of simulating the non-linearity of the peripheral auditory system. Therefore, the sEPSM is incapable of reflecting features of peripheral auditory systems of hearing-impaired persons with various degrees of non-linear impairments. Hence, it has been difficult to use the sEPSM for the speech enhancement/noise reduction signal processing that is intended for hearing aids, disadvantageously.

The dcGC-sEPSM, too, uses a residual noise component (the residual noise (~N) illustrated in FIG. 8) as an input signal, in the same manner as the sEPSM. Therefore, the dcGC-sEPSM is also only capable of calculating an intelligibility for a speech enhancement technique capable of estimating both of the enhanced speech and the residual noise component, and the applicable scope of the dcGC-sEPSM has been limited.

The present invention is made in consideration of the above, and an object of the present invention is to provide a speech intelligibility calculating method, a speech intelligibility calculating apparatus, and a speech intelligibility calculating program capable of estimating a speech intelligibility highly accurately, without any dependency on a speech enhancement method.

SOLUTION TO PROBLEM

To address the issue and to achieve the objective described above, a speech intelligibility calculating method according to the present invention is a speech intelligibility calculating method executed by a speech intelligibility calculating apparatus, the speech intelligibility calculating method includes: a speech intelligibility calculating step of finding a feature of a distortion component that is a difference between a temporal amplitude envelope signal that is a feature of an input clean speech and a temporal amplitude envelope signal that is a feature of an enhanced speech, using a plurality of filter banks, and of calculating a speech intelligibility that is an objective assessment index of a speech quality based on the found difference component between the feature of the clean speech and the feature of the distortion component; and a step of outputting the speech intelligibility calculated at the speech intelligibility calculating step.

Advantageous Effects of Invention

According to the present invention, it is possible to calculate a speech intelligibility without any dependency on a speech enhancement method.

DESCRIPTION OF EMBODIMENTS

One embodiment of the present invention will now be explained in detail with reference to some drawings. The embodiment is, however, not intended to limit the scope of the present invention in any way. In the descriptions of the drawings, the same parts are illustrated using the same reference signs.

Embodiment

An embodiment of the present invention will now be explained. In the embodiment of the present invention, a GEDI speech intelligibility calculating apparatus that uses a GEDI technique will be explained.

Figure 1:
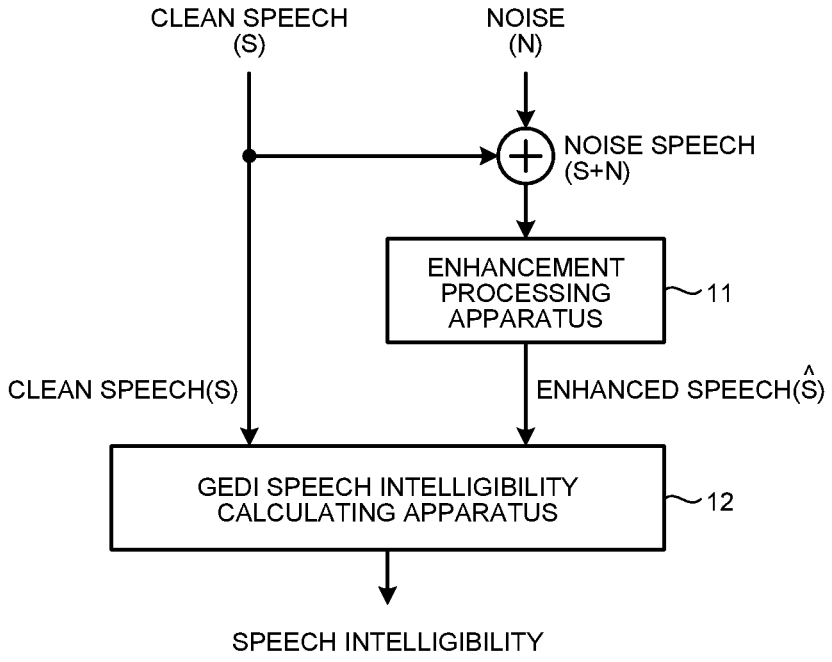
FIG. 1 is a schematic for generally illustrating a system including a gammachirp envelope distortion index (GEDI) speech intelligibility calculating apparatus according to an embodiment.

To begin with, a configuration of the speech intelligibility calculating apparatus according to the embodiment will be explained. FIG. 1 is a schematic for generally illustrating a system including the GEDI speech intelligibility calculating apparatus according to the embodiment. This GEDI speech intelligibility calculating apparatus 12 according to the embodiment receives an input of an enhanced speech (ˆS) from an enhancement processing apparatus 11 and an input of a clean speech (S), and outputs a speech intelligibility that is an objective assessment index of a speech quality.

The enhancement processing apparatus 11 applies speech enhancement to a noisy speech (S+N) that is a result of adding a noise (N) to the clean speech (S), and outputs an enhanced speech (ˆS) corresponding to the noisy speech (S+N) to the GEDI speech intelligibility calculating apparatus 12. The clean speech (S) is an original speech signal before the noise superimposition. The GEDI speech intelligibility calculating apparatus 12 that is at the stage subsequent to the enhancement processing apparatus 11 also receives an input of the clean speech (S) before the noise superimposition. In this manner, because it is not necessary for the enhancement processing apparatus 11 to calculate a residual noise component and to input the residual noise component to the GEDI speech intelligibility calculating apparatus 12, it is possible to use any speech enhancement technique, including those having a difficulty in calculating a residual noise component.

The GEDI speech intelligibility calculating apparatus 12 receives inputs of the noisy speech or the enhanced speech (ˆS) for which a speech intelligibility is to be predicted, and the clean speech (S). The GEDI speech intelligibility calculating apparatus 12 finds a feature of a distortion component (D) that is a difference between a temporal amplitude envelope signal that is a feature of the input clean speech and an amplitude envelope signal that is a feature of the enhanced speech, using a plurality of filter banks, and calculates a speech intelligibility based on a difference between the found feature of the clean speech and the feature of the distortion component. The GEDI speech intelligibility calculating apparatus 12 then outputs the speech intelligibility having been calculated correspondingly to the input signals. The GEDI speech intelligibility calculating apparatus 12 estimates the distortion component (D) included in the enhanced speech from the temporal amplitude envelope signal of the clean speech (S) and the temporal amplitude envelope signal of the enhanced speech (ˆS), and then calculates the speech intelligibility. The GEDI speech intelligibility calculating apparatus 12 calculates signal-to-distortion ratio of envelope ($SDR_{env}$), which is used as the basis for calculating a speech intelligibility, from the temporal amplitude envelope signal of the clean speech (S) and the temporal amplitude envelope signal of the enhanced speech (ˆS). As steps for calculating a speech intelligibility, the GEDI speech intelligibility calculating apparatus 12 performs a step of finding a temporal distortion signal based on the amplitude envelope signal of the clean speech and the amplitude envelope signal of the enhanced speech, and a step of calculating a signal-to-distortion ratio (SDR) that is a difference component between the clean speech and the distortion signal, based on the feature of the distortion signal and the feature of the clean speech. Specifically, as the steps for calculating a speech intelligibility, the GEDI speech intelligibility calculating apparatus 12 performs a step of finding a temporal distortion signal based on the amplitude envelope signal of the clean speech and the amplitude envelope signal of the enhanced speech, a step of calculating a signal-to-distortion ratio (SDR) that is a difference component between the clean speech and the distortion signal, based on the feature of the distortion signal and the feature of the clean speech, and a step of calculating a speech intelligibility that is an objective assessment index of a speech quality, based on the difference component.

The GEDI speech intelligibility calculating apparatus 12 performs a frequency analysis of the input signals using a dynamic compressive gammachirp (dcGC) filter bank, and performs a filter bank analysis of the resultant amplitude envelopes using a band-pass filter bank in a modulation frequency domain. With the use of the dynamic compressive gammachirp (dcGC) filter bank, the GEDI speech intelligibility calculating apparatus 12 makes it possible to reflect features of hearing-impaired persons, as well as features of hearing persons, and to make an accurate prediction of the intelligibility of an enhanced speech.

[Functional Configuration of GEDI Speech Intelligibility Calculating Apparatus]

Figure 2:
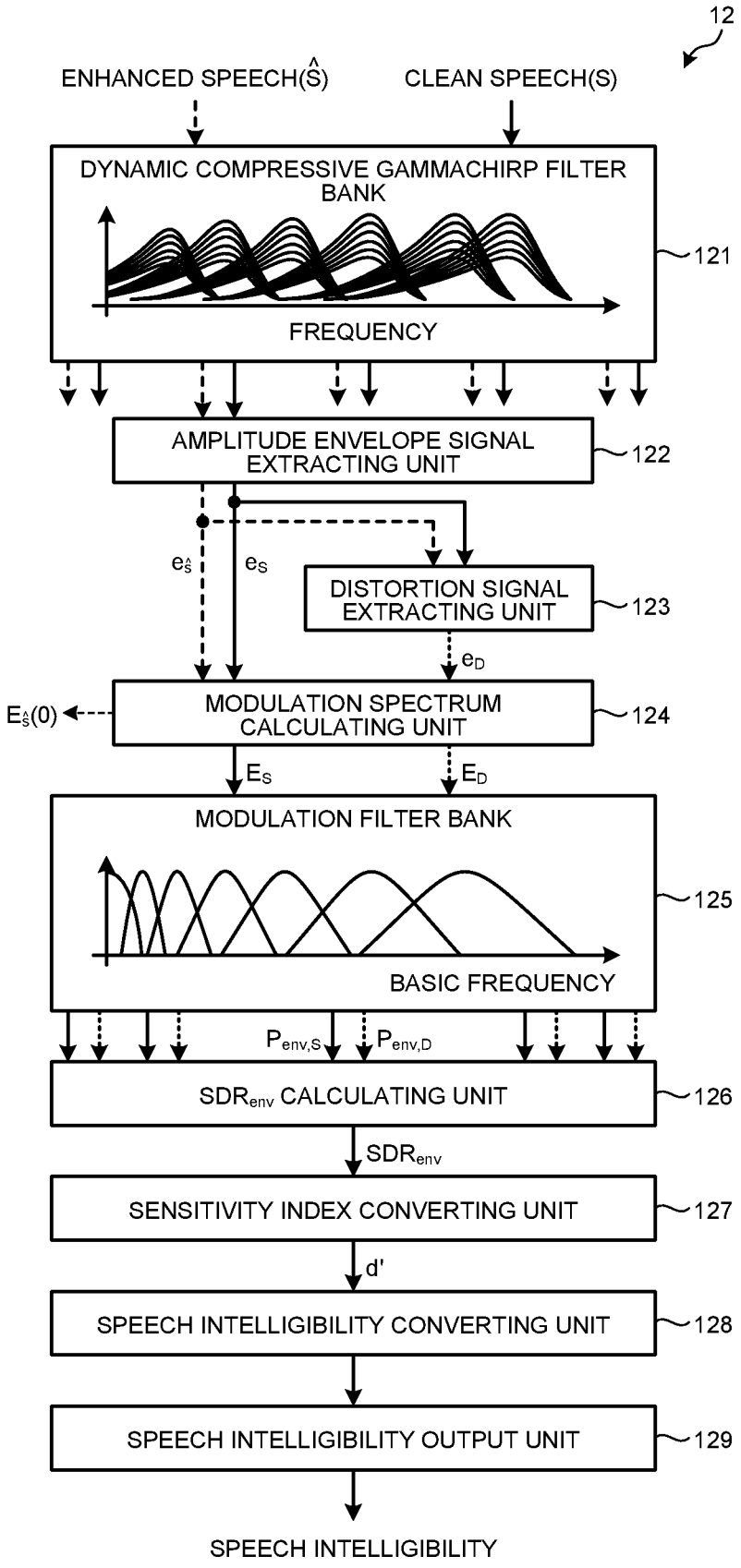
FIG. 2 is a schematic giving a schematic representation of functions of the GEDI speech intelligibility calculating apparatus illustrated in FIG. 1.

The GEDI speech intelligibility calculating apparatus 12 will now be explained. FIG. 2 is a schematic giving a schematic representation of functions of the GEDI speech intelligibility calculating apparatus 12 illustrated in FIG. 1.

As illustrated in FIG. 2, the GEDI speech intelligibility calculating apparatus 12 is implemented on a general-purpose computer, such as a work station or a personal computer, and, by causing a processor such as a central processing unit (CPU) to execute a processing program stored in a memory, functions as a dynamic compressive gammachirp filter bank 121 (first filter bank), an amplitude envelope signal extracting unit 122, a distortion signal extracting unit 123, a modulation spectrum calculating unit 124, a modulation filter bank 125 (second filter bank), an $SDR_{env}$ calculating unit 126, a sensitivity index converting unit 127, a speech intelligibility converting unit 128, and a speech intelligibility output unit 129, as illustrated in FIG. 2. Although not illustrated, the GEDI speech intelligibility calculating apparatus 12 also includes an input unit for receiving inputs of an enhanced speech (ˆS) and a clean speech (S), and outputting the enhanced speech (ˆS) and the clean speech (S) to the dynamic compressive gammachirp filter bank 121.

The dynamic compressive gammachirp filter bank 121 receives inputs of an enhanced speech (ˆS) and a clean speech (S), and outputs information of the amplitude envelopes of the enhanced speech (ˆS) and of the clean speech (S). The dynamic compressive gammachirp filter bank 121 includes "I" channels of gammachirp auditory filters in total. The dynamic compressive gammachirp filter bank 121 performs a frequency analysis of the input signals using each one of the "I" channels in total. The dynamic compressive gammachirp filter bank 121 then outputs the signal having passed the dynamic compressive gammachirp filter at the corresponding channel, as a response time signal corresponding to that bandwidth. The dynamic compressive gammachirp filter bank 121 outputs "I" time signals corresponding to the noisy speech or the enhanced speech, and "I" time signals corresponding to the clean speech.

Using the amplitude envelope information output from the filter bank, the amplitude envelope signal extracting unit 122 calculates a temporal amplitude envelope signal of the feature of the clean speech and a temporal amplitude envelope signal of the feature of the noisy speech or the enhanced speech. The amplitude envelope signal extracting unit 122 calculates the temporal amplitude envelope signal by performing a Hilbert transform of the $i^{th}$ channel output from the dynamic compressive gammachirp filter bank 121, and applying a lowpass filter having a cutoff frequency at 150 Hz. In this manner, the amplitude envelope signal extracting unit 122 outputs an amplitude envelope signal ($e_{\hat{S},i}(n)$) corresponding to the noisy speech, and an amplitude envelope signal ($e_{s,i}(n)$) corresponding to the clean speech, where "n" is the number of samples of the amplitude envelope signals.

Based on a difference between the temporal amplitude envelope signal representing the feature of the clean speech and the temporal amplitude envelope signal representing the feature of the noisy speech or the enhanced speech, the temporal amplitude envelope signals being calculated by the amplitude envelope signal extracting unit 122 based on the outputs of the filter bank, the distortion signal extracting unit 123 extracts a temporal distortion signal. The distortion signal extracting unit 123 receives the amplitude envelope signal ($e_{\hat{S},i}(n)$) corresponding to the noisy speech or the enhanced speech and the amplitude envelope signal ($e_{s,i}(n)$) corresponding to the clean speech, these amplitude envelope signals being output from the amplitude envelope signal extracting unit 122, and calculates a temporal distortion signal ($e_D$) to be found from both of these signals using Equation (1) below.

$$e_{D,i}(n) = (|\{e_{S,i}(n)\}^p - \{e_{S,i}(n)\}^p|)^{\frac{1}{p}} \tag{1}$$

In Equation (1), $i\{i|1 \le i \le I\}$ is the index of channels in the dynamic compressive gammachirp filter bank 121, and p is a constant, where p=2 is used, for example. The distortion signal extracting unit 123 finds the signals in a number corresponding to the number of channels in the dynamic compressive gammachirp filter bank 121 ("I" channels), and outputs the distortion signal.

The modulation spectrum calculating unit 124 receives inputs of the amplitude envelope signal ($e_{\hat{S},i}$) corresponding to the noisy speech or the enhanced speech, and the amplitude envelope signal ($e_{s,i}$) corresponding to the clean speech, these amplitude envelope signals being output from the amplitude envelope signal extracting unit 122, and also receives an input of the distortion signal ($e_{D,i}$) found by the distortion signal extracting unit 123. The modulation spectrum calculating unit 124 calculates modulation power spectrums ($E_{\hat{S},i}$, $E_{S,i}$, $E_{D,i}$) corresponding to these signals, by applying Fourier transform to these signals.

The modulation filter bank 125 is a band-pass filter bank in a modulation frequency domain. The modulation filter bank 125 analyzes the modulation power spectrums ($E_{S,i}$, $E_{D,i}$) calculated by the modulation spectrum calculating unit 124, using the modulation filter bank ("J" channels in total). The modulation filter bank 125 is applied as the absolute value of the modulation spectrum based on a modulation frequency $f_{env}$. For each channel of the modulation filter bank, the modulation filter bank 125 calculates an output power spectrum $P_{env,i,j}$ that is the clean speech or the distortion signal weighted by modulation filter bank. The output power spectrum $P_{env,i,j}$ obtained by applying a power spectrum $W_j(f_{env})$ of the $j^{th}$ modulation filter $\{j|1 \le j \le J\}$ is found with the use of Equation (2) below.

$$P_{env,*,i,j} = \frac{1}{E_{\hat{S},i}(0)^2} \int_{f_{env}>0}^{\infty} |E_{*,i}(f_{env})|^2 W_j(f_{env}) df_{env} \quad (2)$$

Where $W_1$ (f) is a third-order low-pass filter using a Butterworth filter (see Reference 1: "Butterworth filter", [online], Wikipedia, [searched on Jun. 14, 2018], Internet ja.wikipedia.org/wiki/%E3%83%90%E3%82%BF%E3%83%BC%E3%83%AF%E3%83%BC%E3%82%B9%E3%83%95%E3%82%A3%E3%83%AB%E3%82%BF, and a square of a transfer function for a second-order band-pass filter (LC resonance filter) may be used as $W_2$ (f) to $W_J$ (f) (see Reference 2: Electrical Engineering: Principles and Applications (4th Edition), by Allan R. Hambley, 2008).

The asterisk (*) in Equation (2) corresponds to the distortion signal D or the clean speech S. $E_{\hat{S},i}(0)$ in Equation (2) is the power spectrum $E_{\hat{S},i}$ of a zero$^{th}$-order component (DC component) of the amplitude envelope signal corresponding to the noisy speech or the enhanced speech, found by the modulation spectrum calculating unit 124. In the calculation of the output power spectrum representing the clean speech or the distortion signal, normalization by this zero$^{th}$-order component (DC component) is performed. $P_{env,*,i,j}$ is set as $3P_{env,*,i,j}=\max(P_{env,*,i,j}, 0.01)$, for example, as a minimum value, as an internal noise in the modulation frequency domain. In this embodiment, it is assumed that, as an example, the number of channels "I" in the dynamic compressive gammachirp filter bank 121 is 100, and the number of channels "J" in the modulation filter bank is 7. With these settings, the modulation filter bank 125 outputs 700 modulation power spectrums $P_{env,*,i,j}$ in total.

The $SDR_{env}$ calculating unit 126 calculates a signal-to-distortion ratio ($SDR_{env}$) between the weighted clean speech and the weighted distortion signal, as a difference component. The $SDR_{env}$ calculating unit 126 calculates the signal-to-distortion ratio ($SDR_{env}$) in the modulation frequency domain, using the modulation power spectrum of the clean speech ($P_{env,S}$) and the modulation power spectrum of the distorted signal ($P_{env,D}$). As indicated by Equation (3) below, $SDR_{env,j}$ at each modulation filter channel j is obtained based on a ratio between the sum of $P_{env,s,i,j}$ and the sum of $P_{env,D,i,j}$ across the entire channels of the dynamic compressive gammachirp filter.

$$SDR_{env,j} = \frac{\sum_{i=1}^{I} P_{env,S,i,j}}{\sum_{i=1}^{I} P_{env,D,i,j}} \quad (3)$$

The $SDR_{env}$ calculating unit 126 then calculates the entire $SDR_{env}$ using Equation (4) below.

$$SDR_{env} = \sqrt{\sum_{j=1}^{J} (SDR_{env,j})^2} \quad (4)$$

The sensitivity index converting unit 127 converts the value of $SDR_{env}$ calculated by the $SDR_{env}$ calculating unit 126 into a sensitivity index d' corresponding to an ideal observer, using Equation (5) below. In Equation (5), "k" and "q" are parameter constants.

$$d' = k \cdot (SDR_{env})^q \quad (5)$$

The speech intelligibility converting unit 128 receives an input of the sensitivity index d' found by the sensitivity index converting unit 127, and converts the sensitivity index d' to a speech intelligibility (a value between 0 and 1) using the equal-variance Gaussian model and the m-alternative forced choice (mAFC) model. In other words, the speech intelligibility converting unit 128 converts the sensitivity index d' into a speech intelligibility by applying following Equation (6) to the sensitivity index d', and outputs the speech intelligibility.

$$P_{correct}(d') = \Phi\left(\frac{d' - \mu_N}{\sqrt{\sigma_S^2 + \sigma_N^2}}\right) \quad (6)$$

Where $\Phi$ is a cumulative Gaussian distribution. $\mu_N$ and $\sigma_N$ are dependent on the number of alternatives m as a response, the alternatives being presumed from a speech specimen. Specifically, $\mu_N$ is expressed by Equation (7), and $\sigma_N$ is expressed by Equation (8). $U_N$ in Equations (7) and (8) is expressed by Equation (9). $\Phi^{-1}$ in Equation (9) is an inverse function of a normal cumulative distribution.

$$\mu_N = U_n + \frac{0.577}{U_n} \quad (7)$$

$$\sigma_N = \frac{1.28255}{U_n} \quad (8)$$

$$U_n = \Phi^{-1}\left(1 - \frac{1}{m}\right) \quad (9)$$

$\sigma_s$ is a parameter that is assumed to be associated with redundancy in a speech specimen. $\sigma_s$ is smaller when the speech is a simple sentence that makes sense, and $\sigma_s$ is greater when the speech is a single-syllable speech without any redundancy. Specific settings of $\sigma_s$ will be described later.

The speech intelligibility output unit 129 outputs the speech intelligibility calculated by the speech intelligibility converting unit 128 to the external. The speech intelligibility output unit 129 is a communication interface, for example, and outputs the speech intelligibility to the external over a network, for example. Alternatively, the speech intelligibility output unit 129 stores the speech intelligibility in a storage medium. The speech intelligibility output unit 129 may also be a liquid-crystal display or a printer, for example.

Process Performed by GEDI Speech Intelligibility Calculating Apparatus

Figure 3:
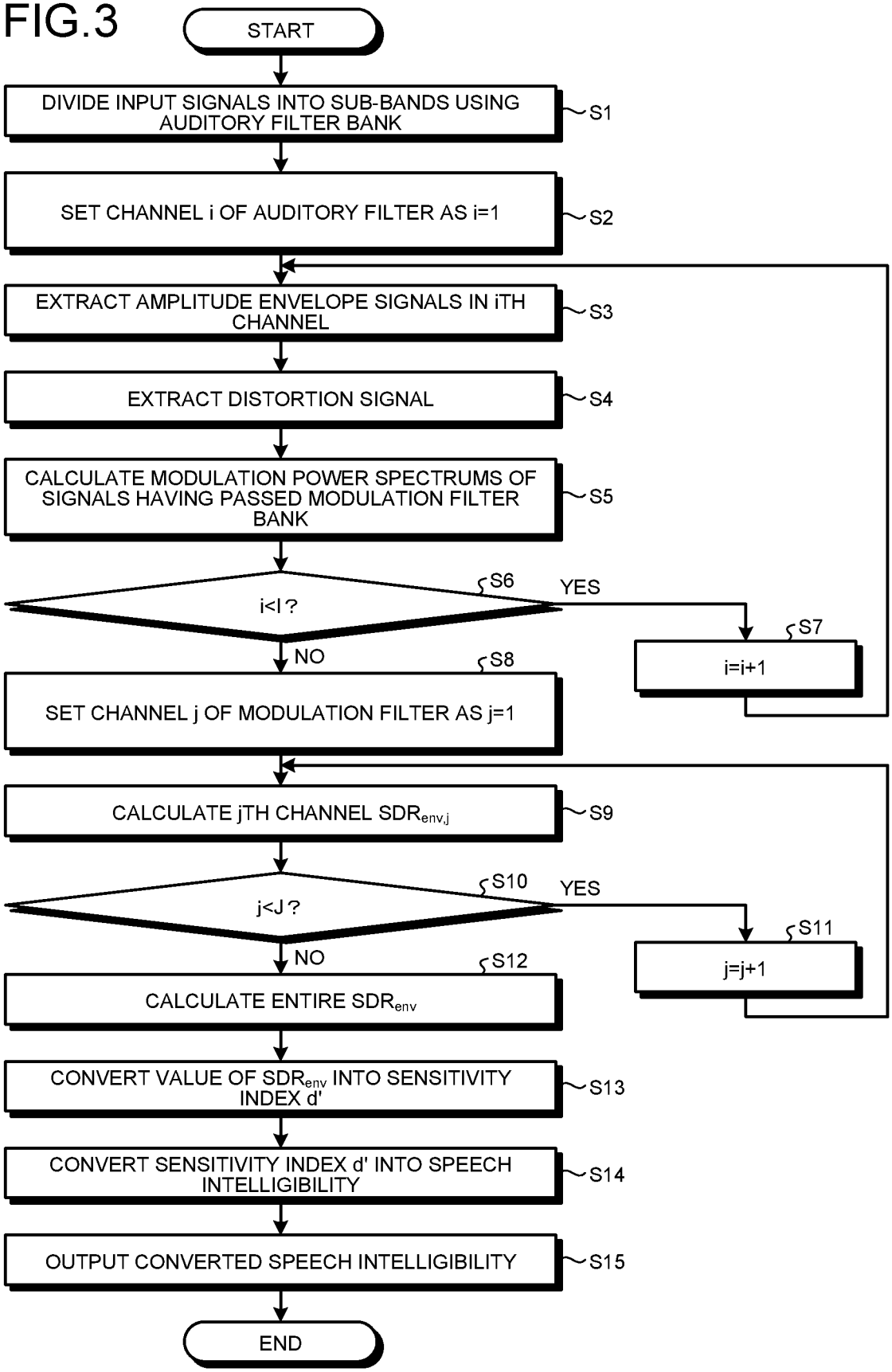
FIG. 3 is a flowchart illustrating the sequence of a speech intelligibility calculating process according to the embodiment.

A process performed by the GEDI speech intelligibility calculating apparatus 12 illustrated in FIG. 2 will now be explained. FIG. 3 is a flowchart illustrating the sequence of the speech intelligibility calculating process according to the embodiment.

To begin with, the GEDI speech intelligibility calculating apparatus 12 receives an enhanced speech or a noisy speech ($\hat{S}$) for which a speech intelligibility is to be predicted, and a clean speech (S) as input signals, and divides the input signals into sub-bands using the dynamic compressive gammachirp filter bank 121 that is an auditory filter bank (Step S1). The GEDI speech intelligibility calculating apparatus 12 then sets the channel i of the auditory filter as i=1 (Step S2).

The amplitude envelope signal extracting unit 122 then extracts an amplitude envelope signal $e_{\hat{S},i}(n)$ corresponding to the noisy speech or the enhanced speech, and an amplitude envelope signal $e_{S,i}(n)$ corresponding to the clean speech, in the $i^{th}$ channel (Step S3). The distortion signal extracting unit 123 then receives inputs of the $i^{th}$ channel amplitude envelope signals ($e\hat{}_{S,i}(n)$, $e_{S,i}(n)$), and extracts a temporal distortion signal ($e_D$), using Equation (1) (Step S4). From the modulation power spectrums ($E_{\hat{}S,i}$, $E_{S,i}$, $e_{D,i}$) calculated by the modulation spectrum calculating unit 124, the modulation filter bank 125 then calculates modulation power spectrums $P_{env,i,j}$ of the signals having passed the modulation filter bank, using Equation (2) (Step S5).

The GEDI speech intelligibility calculating apparatus 12 then determines whether i<I is established (Step S6). If it is determined that i<I is established (Yes at Step S6), the GEDI speech intelligibility calculating apparatus 12 sets i=i+1 (Step S7). The system control goes back to Step S3, and the extraction of the amplitude envelope signals in the next $i^{th}$ channel is then performed. If the GEDI speech intelligibility calculating apparatus 12 determines that i<I is not established (No at Step S6), the channel j of the modulation filter is set as j=1 (Step S8).

The $SDR_{env}$ calculating unit 126 then calculates the $j^{th}$ channel $SDR_{env,j}$, using Equation (3), based on the modulation power spectrum ($P_{env,S}$) of the clean speech and the modulation power spectrum ($P_{env,D}$) of the distortion signal (Step S9). The $SDR_{env}$ calculating unit 126 then determines whether j<J is established (Step S10). If it is determined that j<J is established (Yes at Step S10), the $SDR_{env}$ calculating unit 126 sets j=j+1 (Step S11). The system control then goes back to Step S9, and the $SDR_{env}$ in the next $j^{th}$ channel is calculated.

If it is determined that j<J is not established (No at Step S10), the $SDR_{env}$ calculating unit 126 calculates the entire $SDR_{env}$ using Equation (4) (Step S12). The sensitivity index converting unit 127 then converts the value of $SDR_{env}$ into a sensitivity index d', using Equation (5) (Step S13). The speech intelligibility converting unit 128 then converts the sensitivity index d' into a speech intelligibility using the equal-variance Gaussian model and the mAFC model (Step S14). The speech intelligibility output unit 129 then outputs the converted speech intelligibility (Step S15), and the process is ended.

[Listening Experiment]

Using the technique disclosed in the embodiment, a listening experiment was carried out. Speech intelligibility assessments were made using the spectrum subtraction (SS) and Wiener filter-based noise reduction (WF). The 4-mora word speeches uttered by male speakers (mis), and recorded in the Familiarity-controlled Word-lists (FW07) were used as the speech specimens. Pink noise was then superimposed over the speech specimen as the noise, while changing the signal-to-noise ratio (SNR) at an increment of 3 dB within the range between −6 dB and 3 dB. The speech enhancement processes described above were then applied to the noise-superimposed speeches as the original speeches (hereinafter, referred to as "unprocessed"). Four hundred speech stimuli were presented in total, including those in five different conditions (unprocessed, $SS^{(1,0)}$, $WF^{(0,0)}_{PSM}$, $WF^{(0,1)}_{PSM}$, $WF^{(0,2)}_{PSM}$) and having four different SNRs (−6, −3, 0, 3 dB).

In this listening experiment, four male and five female subjects with normal hearing at the age from 20 to 23 participated. The speech stimuli were then randomly presented to the experiment participants, and the experiment participants wrote down the 4-mora speeches they heard on the answer sheet in Hiragana. In this experiment, only the complete match was considered as a correct answer, and the speech intelligibility was calculated as a percentage at the end. Every experiment participant was confirmed to have healthy hearing capability, using an audiogram within the range of 125 Hz and 8000 Hz. Prior to the experiment, an informed consent about this listening experiment was obtained from each participant.

In order to examine whether the technique according to the embodiment (GEDI) was capable of predicting the result of the listening experiment correctly, a different speech set was prepared for each subject, and the GEDI calculated the speech intelligibility for the speech data set. Among the GEDI parameters, the number of response alternatives was set to m=20000, considering an estimation of the mental lexicon size corresponding to FW07 and low familiarity of the speech specimen used in this experiment. As a result of carrying out fitting in such a manner that the mean-squared errors (MSE) of the predicted speech intelligibilities ("unprocessed") with respect to the listening experiment results were minimized, the remaining parameters were established as k=1.17, $\sigma_s$=1.62.

Figure 4:
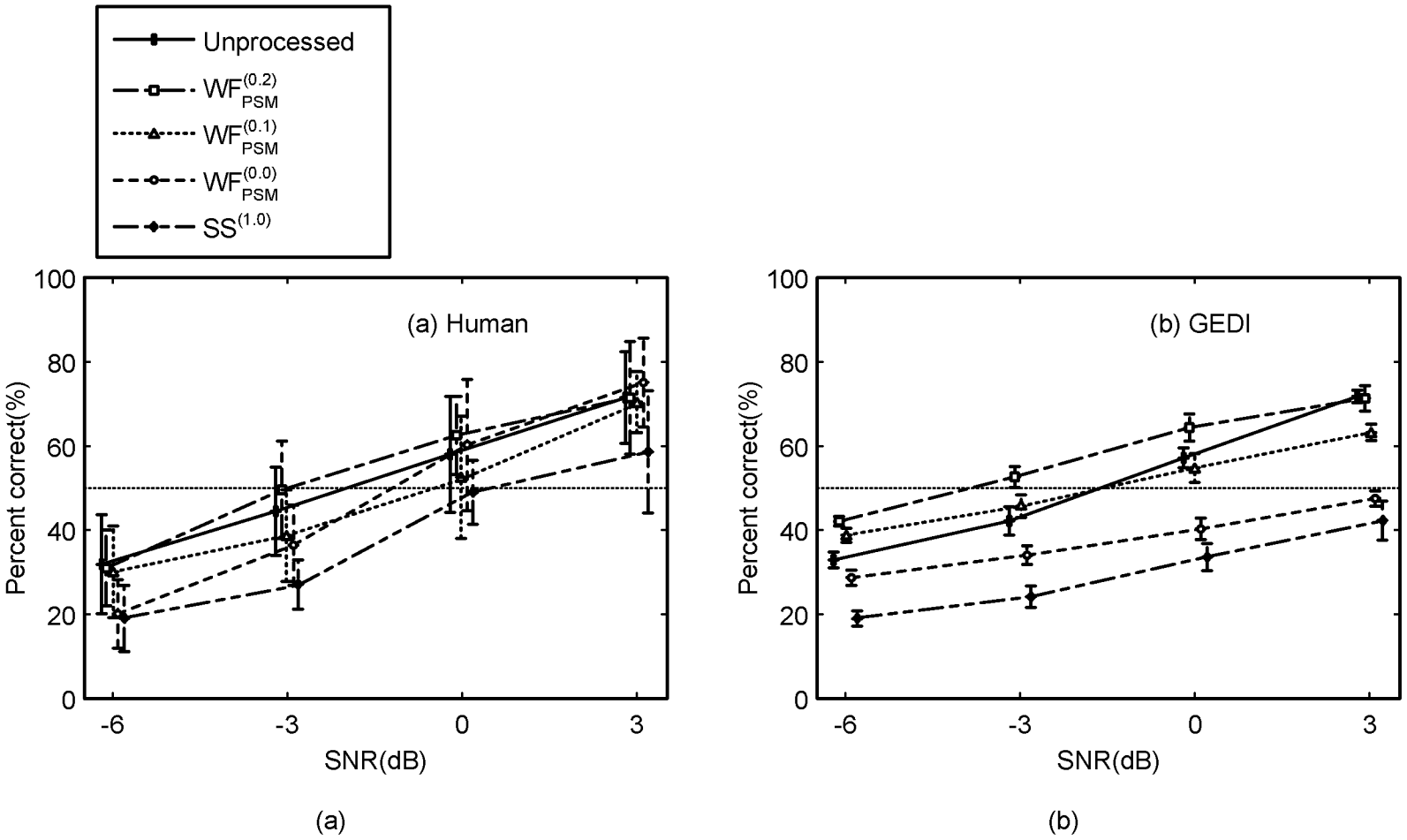
FIG. 4 is a schematic illustrating results of a listening experiment and prediction results of the GEDI speech intelligibility prediction method.

FIG. 4 is a schematic illustrating the results of the listening experiment, and the prediction results achieved by the GEDI speech intelligibility prediction method. FIG. 4(*a*) illustrates the results of the listening experiment. FIG. 4(*b*) illustrates the prediction results achieved by the GEDI speech intelligibility prediction method. The horizontal axis represents the SNR in the "unprocessed" (the noise-superimposed speeches before the noise reduction processing is applied). The results of the listening experiment and those achieved by the GEDI include five curves, four of which correspond to the four types of noise reduction processing (spectrum subtraction) ($SS^{(1,0)}$), and Wiener filter-based noise reductions $WF^{(0,0)}_{PSM}$, $WF^{(0,1)}_{PSM}$, $WF^{(0,2)}_{PSM}$), and the remaining one of which corresponds to "unprocessed".

The plot in FIG. 4(*a*) represents the average of results found from the nine subjects, and the plot in FIG. 4(*b*) represents the average of the speech intelligibility predictions calculated by the GEDI for the entire set of data used in each type of the listening experiment. The vertical bars in the plot represent standard deviations.

In the results of the listening experiment (FIG. 4(*a*)), the speech intelligibility curve of $WF^{(0,2)}_{PSM}$ exhibited higher correctness than that of "unprocessed". In the results of the listening experiment (FIG. 4(*a*)), by contrast, the speech intelligibility curves of $WF^{(0,1)}_{PSM}$ and $SS^{(1,0)}$ exhibited lower correctness than that of "unprocessed". The speech intelligibility curve $WF^{(0,0)}_{PSM}$ was higher than that of "unprocessed" when the SNR was higher, and was lower than that of "unprocessed" when the SNR was lower. Based on these results, the perceptual assessments by the listening experiment suggests that the noise reduction $WF^{(0,2)}_{PSM}$ successfully improved the speech intelligibilities of the noise-superimposed speeches.

The GEDI that is the technique according to the embodiment made speech intelligibility predictions (FIG. 4(*b*)) near the results obtained by the listening experiment (FIG. 4(*a*)). In other words, the speech intelligibility prediction results of the GEDI obtained for the all of the noise reductions were plotted in the order of $WF^{(0,2)}_{PSM}$>$WF^{(0,1)}_{PSM}$>$WF^{(0,0)}_{PSM}$>$SS^{(1,0)}$, and these curves exhibited almost parallel positional relations. In the results of the speech intelligibility prediction performed by the GEDI, the speech intelligibility curve of $WF^{(0,2)}_{PSM}$ was plotted higher than unprocessed, in the same manner as in the listening experiment. In this manner, it can be seen that, among the noise reduction processing subjected to this experiment, $WF^{(0,2)}$ exerted the highest noise reduction performance. In the results of the speech intelligibility prediction performed by the GEDI, $SS^{(1,0)}$ always exhibited the lowest performance, than those achieved under any other processing conditions.

In the manner described above, because the results of the speech intelligibility prediction performed by the GEDI indicated an extremely high correlation with the results of the listening experiment, it can be concluded that the GEDI has calculated the speech intelligibility highly accurately.

Advantageous Effects Achieved by Embodiment

In the manner described above, the GEDI speech intelligibility calculating apparatus according to the embodiment estimates a distortion component ($e_D$) included in an enhanced speech, based on a difference between the temporal amplitude envelope signal of the clean speech and the temporal amplitude envelope signal of the enhanced speech, and calculates $SDR_{env}$ that is used as the basis for calculating a speech intelligibility that is an objective assessment index of a speech quality, using the features of the distortion component and of the clean speech.

The GEDI speech intelligibility calculating apparatus 12 receives an input of a clean speech before the noise superimposition. Therefore, the enhancement processing apparatus 11 positioned at a stage preceding the GEDI speech intelligibility calculating apparatus 12 does not need to calculate a residual noise component, and to input the residual noise component to the GEDI speech intelligibility calculating apparatus 12. In other words, it is not necessary to calculate the residual noise component, which has been required for the conventional assessment index (sEPSM, dcGC-sEPSM). Therefore, the enhancement processing apparatus 11 can be applied to any speech enhancement technique, and calculate a speech intelligibility without any dependency on a speech enhancement technique. In other words, compared with the conventional sEPSM and dcGC-sEPSM, it is not necessary to perform an estimating process that is dependent on the speech enhancement processing, so that a highly convenient object assessment index calculation can be achieved.

The GEDI speech intelligibility calculating apparatus 12 uses the dynamic compressive gammachirp filter bank (dcGC) as the auditory filter bank, in the same manner as dcGC-sEPSM does. The dcGC-sEPSM is capable of reflecting the features of hearing-impaired persons as well as the features of hearing persons. Therefore, with this embodiment, the gammachirp filter bank parameters found from audiometry can be introduced directly to reflect the features of hearing-impaired persons, so that the GEDI speech intelligibility calculating apparatus 12 according to the embodiment can be applied to the speech intelligibility estimation for hearing-impaired persons.

The GEDI speech intelligibility calculating apparatus 12 can also predict the intelligibility of an enhanced speech more accurately than the conventional sEPSM and dcGC-sEPSM have capable of, even when used is a speech enhancement technique for which there is no clear definition of the residual component, e.g., the latest Wiener filter-base noise reduction. Furthermore, as indicated by the experiment, by predicting and comparing speech intelligibilities for a plurality of different speech enhancement techniques using the technique according to the embodiment, the speech enhancement techniques can be assessed, and a better speech enhancement technique can be selected, more accurately.

In the manner described above, with the embodiment, it is possible to achieve a speech intelligibility calculation without any dependency on a speech enhancement method, and the technique according to the embodiment can be used as a speech intelligibility calculation method for both of hearing persons and hearing aids.

First Modification of Embodiment

A first modification of the embodiment will now be explained. In the first modification, another example of the method for calculating $SDR_{env}$ will be explained.

In the first modification, $SDR_{env}$ is weighted appropriately. In the first modification, a more robust speech intelligibility estimation method is achieved by calculating $SDR_{env}$ by weighing $P_{env,*,i,j}$ (where the asterisk (*) is the distortion signal D or the clean speech (S)) appropriately.

In the first modification, the $SDR_{env}$ calculating unit 126 performs the calculation at Step S9 by giving a weight $V_i$ to the dynamic compressive gammachirp filter in each channel i, as indicated by Equation (10) below.

$$SDR_{env,j} = \frac{\sum_{i=1}^{I} V_i P_{env,S,i,j}}{\sum_{i=1}^{I} V_i P_{env,D,i,j}} \tag{10}$$

As the weight, $V_i$ indicated in Equation (11) below may be used, for example.

$$V_i = \frac{ERB_N(f_0)}{ERB_N(f_i)} \tag{11}$$

Where $ERB_N(f)$ is an equivalent rectangular bandwidth at a frequency f (Hz) (see Reference 3: B. C. J. Moore, "Chapter 3: Frequency Selectivity, Masking, and the Critical Band", in An Introduction to the Psychology of Hearing, Sixth Edition, Brill, pp. 67-132, 2013, for example), and f0 is set to 1000 (Hz), for example.

As the weight $V_i$, it is also possible to use any appropriate weight with which the bandwidth of the auditory filter can be corrected, instead of that indicated in Equation (11).

In the first modification, the same process as that illustrated in FIG. 3 is performed except for the process at Step S9 performed by the $SDR_{env}$ calculating unit 126.

Second Modification of Embodiment

Figure 5:
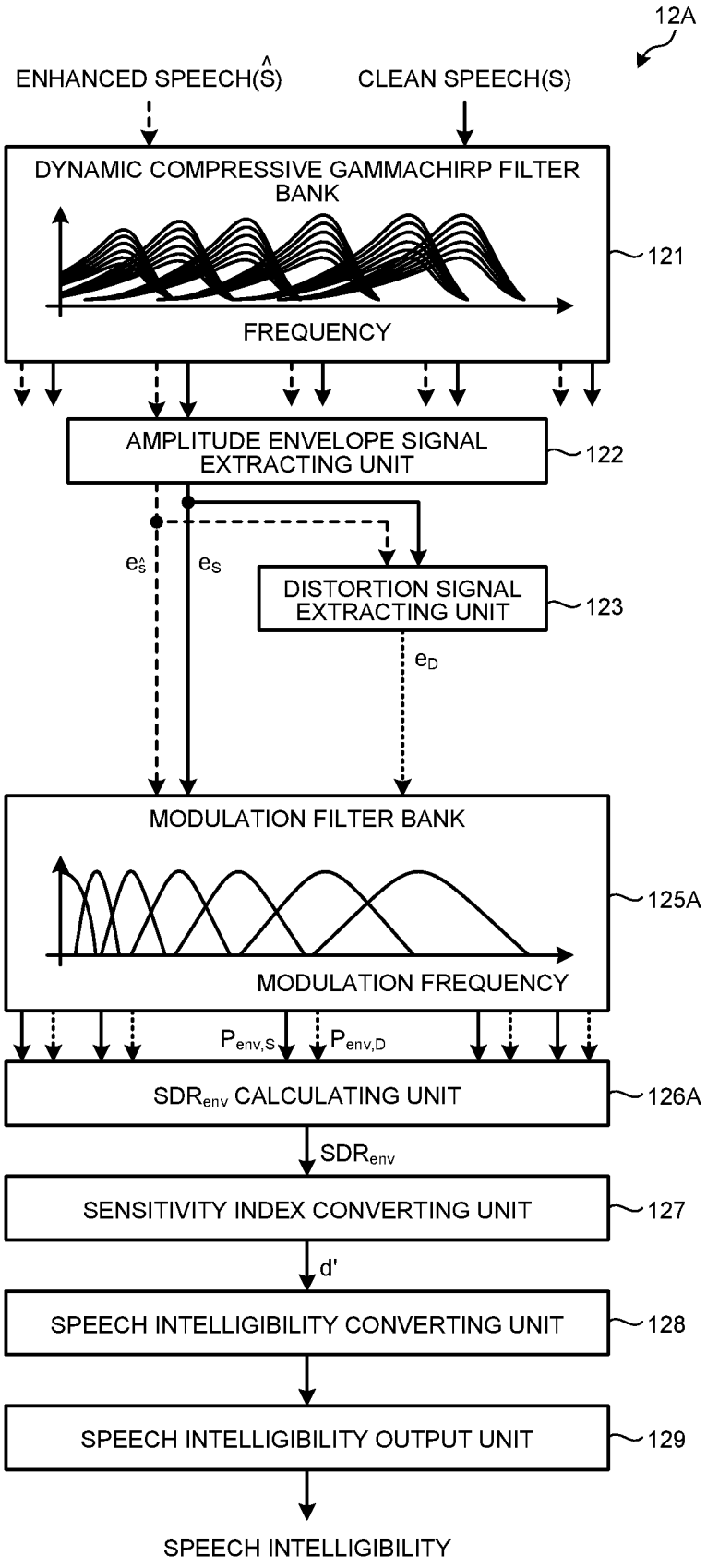
FIG. 5 is a schematic giving a schematic representation of functions of the GEDI speech intelligibility calculating apparatus according to a second modification of the embodiment.

A second modification of the embodiment will now be explained. According to the second modification, a more robust speech intelligibility estimation method is achieved when the noise is non-stationary noise. FIG. 5 is a schematic giving a schematic representation of functions of the GEDI speech intelligibility calculating apparatus according to the second modification of the embodiment.

As illustrated in FIG. 5, this GEDI speech intelligibility calculating apparatus 12A according to the second modification of the embodiment has a configuration in which the modulation spectrum calculating unit 124 is omitted, compared with the GEDI speech intelligibility calculating apparatus 12 illustrated in FIG. 2. The GEDI speech intelligibility calculating apparatus 12A includes a modulation filter bank 125A (second filter bank) and an $SDR_{env}$ calculating unit 126A, instead of the modulation filter bank 125 and the $SDR_{env}$ calculating unit 126, compared with the GEDI speech intelligibility calculating apparatus 12.

The modulation filter bank 125A receives inputs of the temporal amplitude envelope signal $e_{\hat{S},i}(n)$ corresponding to the noisy speech or the enhanced speech and the temporal amplitude envelope signal $e_{S,i}(n)$ corresponding to the clean speech, these temporal amplitude envelopes being output from the amplitude envelope signal extracting unit 122, and the distortion signal $e_{D,i}(n)$ found by the distortion signal extracting unit 123.

To begin with, the modulation filter bank 125A inputs the amplitude envelope signal $e_{S,i}(n)$ and the distortion signal $e_{D,i}(n)$ to the modulation filter bank, and calculates output time series $E_{S,i,j}(n)$ and $E_{D,i,j}(n)$ of the $j^{th}$ modulation filter. Used as the modulation filter bank herein are LPF using a third-order Butterworth filter, and a plurality of second-order band-pass filters, for example.

The modulation filter bank 125A then divides the output time series $E_{s,i,j}(n)$ and $E_{D,i,j}(n)$ into units in a short-time frame, and finds the divided time series in a $t^{th}$ frame on each channel j as $E_{s,i,j,t}(n)$ and $E_{D,i,j,t}(n)$, respectively. The length of the short-time frame is set to the inverse of a cutoff frequency (LPF) or a center frequency (BPF) of the modulation filter bank, for example, and the frame overlap is set to a value between zero and the short-time frame length.

The modulation filter bank 125A then calculates the modulation power spectrum related to each j, using Equation (12), as an output from the modulation filter bank 125A.

$$P_{env,*,i,j,t} = \frac{1}{Av\left[e_{\hat{S},i}(n)\right]_n^2/2} Av[(E_{*i,j,t}(n) - Av[E_{*,i,j,t}(n)]_n)^2]_n \tag{12}$$

In Equation (12), the asterisk (*) is the distortion signal D or the clean speech (S), and $Av[f(n)]_n$ denotes an average-calculating operation related to n in f(n).

The $SDR_{env}$ calculating unit 126A then calculates signal-to-distortion ratio $SDR_{env}$ in the modulation frequency domain, for each of the short-time frames t, based on Equation (13), using the modulation power spectrum $P_{env,S,i,j,t}$ of the clean speech, and the modulation power spectrum $P_{env,D,i,j,t}$ of the distortion signal, as inputs.

$$SDR_{env,j,t} = \frac{\sum_{i=1}^{I} P_{env,S,i,j,t}}{\sum_{i=1}^{I} P_{env,D,i,j,t}} \tag{13}$$

Alternatively, the $SDR_{env}$ calculating unit 126A may also calculate the signal-to-distortion ratio $SDR_{env}$ with Equation (14) in which the weight $V_i$ is used, in the same manner as in the first modification of the embodiment.

$$SDR_{env,j,t} = \frac{\sum_{i=1}^{I} V_i P_{env,S,i,j,t}}{\sum_{i=1}^{I} V_i P_{env,D,i,j,t}} \tag{14}$$

The $SDR_{env}$ calculating unit 126A then calculates the entire $SDR_{env}$ using the $SDR_{env,j,t}$, based on Equation (15) and Equation (16), and outputs the result.

$$SDR_{env,j} = \frac{1}{T_j}\sum_{t=1}^{T_i} SDR_{env,j,t} \tag{15}$$

$$SDR_{env} = \sqrt{\sum_{j=1}^{J} SDR_{env,j}^2} \tag{16}$$

Where $T_j$ is the number of the short-time frames in the $j^{th}$ modulation filter, and this value is uniquely determined by the length of the short-time frame and the length of the input data.

[Process Performed by GEDI Speech Intelligibility Calculating Apparatus]

Figure 6:
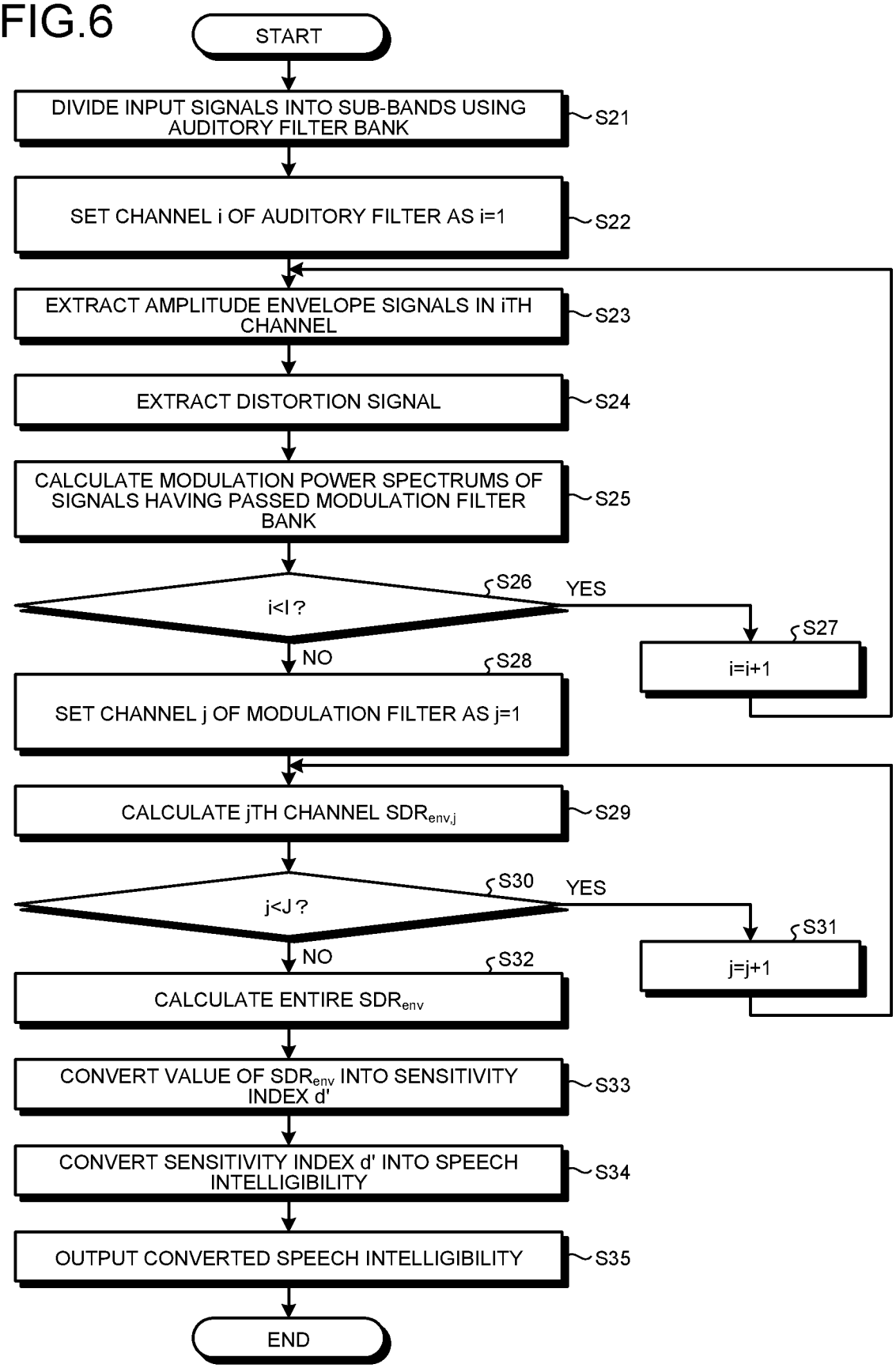
FIG. 6 is a flowchart illustrating the sequence of a speech intelligibility calculating process according to the second modification of the embodiment.

A process performed by the GEDI speech intelligibility calculating apparatus 12A illustrated in FIG. 5 will now be explained. FIG. 6 is a flowchart illustrating the sequence of a speech intelligibility calculating process according to the second modification of the embodiment.

Steps S21 to S24 illustrated in FIG. 6 are the same as Steps S1 to S4 illustrated in FIG. 3.

The modulation filter bank 125A receives inputs of the amplitude envelope signal $e_{\hat{S},i}(n)$ corresponding to the noisy speech or the enhanced speech, the amplitude envelope signal $e_{S,i}(n)$ corresponding to the clean speech, these amplitude envelope signals being output from the amplitude envelope signal extracting unit 122, and the distortion signal $e_{D,i}(n)$ found by the distortion signal extracting unit 123, and calculates the modulation power spectrum of the signals having passed the modulation filter bank (Step S25). Specifically, the modulation filter bank 125A receives inputs of the amplitude envelope signal $e_{\hat{S},i}(n)$ corresponding to the noisy speech or the enhanced speech and the amplitude envelope signal $e_{S,i}(n)$ corresponding to the clean speech, these amplitude envelope signals being output from the amplitude envelope signal extracting unit 122, and the distortion signal $e_{D,i}(n)$ found by the distortion signal extracting unit 123, calculates the modulation power spectrum $P_{env,S,i,j,t}$ of the clean speech and the modulation power spectrum $P_{env,D,i,j,t}$ of the distortion signal, using Equation (12).

Steps S26 to S28 illustrated in FIG. 6 are the same as Steps S6 to S8 illustrated in FIG. 3.

The $SDR_{env}$ calculating unit 126A calculates $SDR_{env}$ using the modulation power spectrum $P_{env,S,i,j,t}$ of the clean speech and the modulation power spectrum $P_{env,D,i,j,t}$ of the distortion signal, as a difference component (Step S29). At this time, the $SDR_{env}$ calculating unit 126A uses one of Equation (13) and Equation (14), and one of Equation (15) and Equation (16).

Steps S30 to S35 illustrated in FIG. 6 are the same as Step S10 to Step S15 illustrated in FIG. 3.

By performing the process according to the second modification of the embodiment, the modulation spectrum calculating unit 124 can be omitted in the GEDI speech intelligibility calculating apparatus 12A.

System Configuration, Etc.

The elements included in the apparatuses illustrated in the drawings are merely functional and conceptual representations, and do not necessarily need to be configured physically as illustrated in the drawings. In other words, the specific configurations in which the apparatuses are distributed or integrated are not limited to those illustrated, and the whole or a part thereof may be distributed or integrated into any units, either functionally or physically, depending on various load or utilization conditions. Furthermore, the whole or any part of the processing functions executed in each of the apparatuses may be implemented as a CPU and a computer program parsed and executed by the CPU, or hardware using wired logics.

Furthermore, among the processes explained in the embodiment, those explained to be performed automatically may be performed manually, entirely or partly, or those explained to be performed manually may be performed automatically, entirely or partly, using any known method. In addition, information including the sequences of processing, the sequences of control, specific names, various data, and parameters mentioned in the above description or the drawings may be changed in any way, unless specified otherwise.

Computer Program

Figure 7:
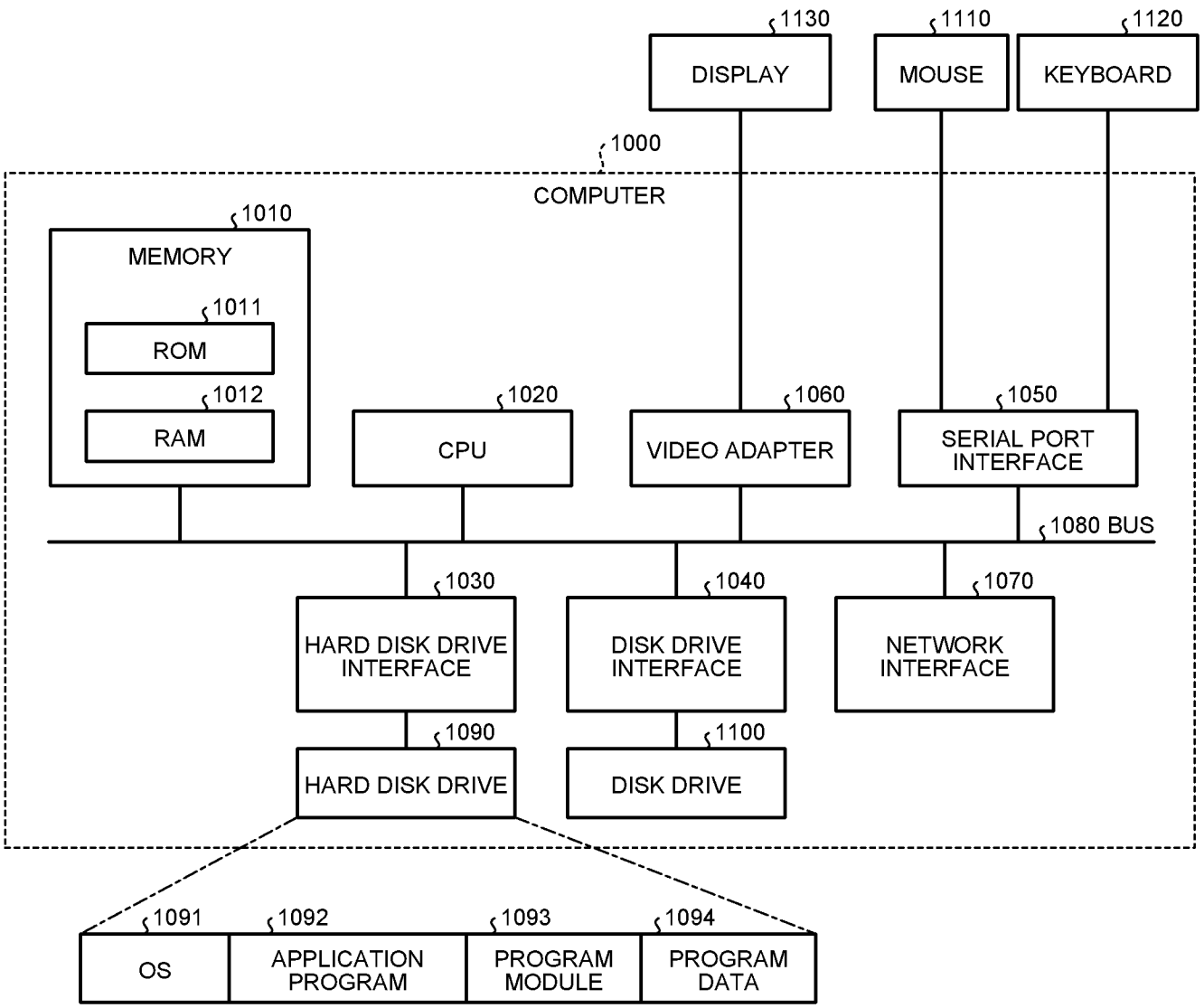
FIG. 7 is a schematic illustrating one example of a computer implementing the GEDI speech intelligibility calculating apparatus, by executing a computer program.
Figure 8:
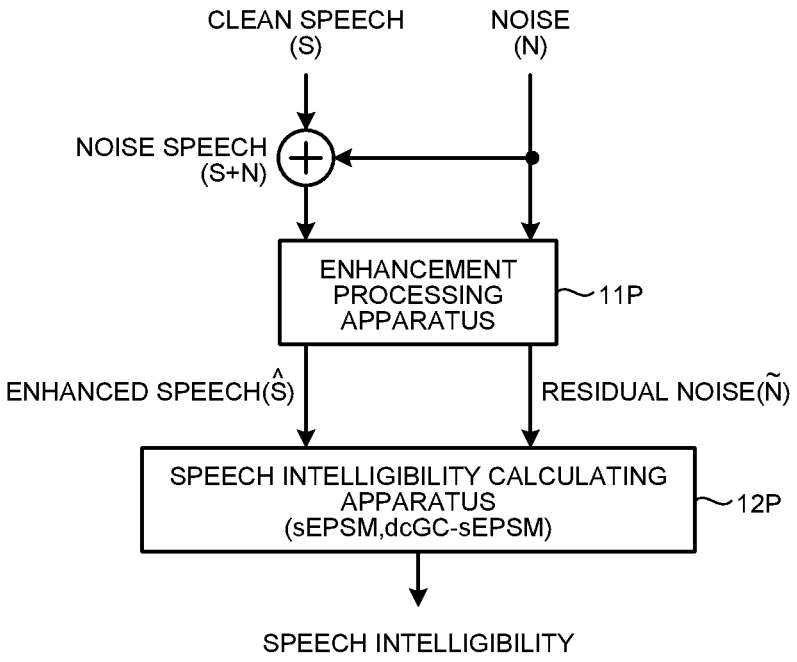
FIG. 8 is a schematic illustrating the framework of a conventional speech intelligibility prediction.

FIG. 7 is a schematic illustrating one example of a computer implementing the GEDI speech intelligibility calculating apparatus 12 by executing a computer program. This computer 1000 includes a memory 1010 and a CPU 1020, for example. The computer 1000 also includes a hard disk drive interface 1030, a disk drive interface 1040, a serial port interface 1050, a video adapter 1060, and a network interface 1070. These units are connected to one another via a bus 1080.

The memory 1010 includes a read-only memory (ROM) 1011 and a random access memory (RAM) 1012. The ROM 1011 stores therein a boot program such as Basic Input Output System (BIOS). The hard disk drive interface 1030 is connected to a hard disk drive 1090. The disk drive interface 1040 is connected to a disk drive 1100. A removable storage medium such as a magnetic disk or an optical disc is inserted into the disk drive 1100. The serial port interface 1050 is connected to a mouse 1110 or a keyboard 1120, for example. The video adapter 1060 is connected to a display 1130, for example.

The hard disk drive 1090 stores therein, for example, an operating system (OS) 1091, an application program 1092, a program module 1093, and program data 1094. In other words, the computer program describing each of the process performed by the GEDI speech intelligibility calculating apparatus 12 is implemented as the program module 1093 in which a computer-executable code is described. The program module 1093 is stored in the hard disk drive 1090, for example. For example, the program module 1093 for executing the same processes as those performed by the functional configurations in the GEDI speech intelligibility calculating apparatus 12 is stored in the hard disk drive 1090. The hard disk drive 1090 may be replaced with a solid state drive (SSD).

Furthermore, setting data used in the processes described in the embodiment is stored in the memory 1010 or the hard disk drive 1090, for example, as the program data 1094. The CPU 1020 then reads the program module 1093 or the program data 1094 stored in the memory 1010 or the hard disk drive 1090 onto the RAM 1012, as required, and executes the items read out.

The storage of the program module 1093 or the program data 1094 is not limited to the hard disk drive 1090, and may be also stored in a removable storage medium, for example, and may be read by the CPU 1020 via the disk drive 1100, for example. Alternatively, the program module 1093 and the program data 1094 may be stored in another computer connected to a network (such as a local area network (LAN) or a wide area network (WAN)). The CPU 1020 may then read the program module 1093 and the program data 1094 from the other computer via the network interface 1070.

An embodiment that is an application of the invention made by the inventors has been explained above, but none of the descriptions and the drawings making up a part of the disclosure of the embodiment of the present invention is intended to limit the scope of the present invention in any way. In other words, any other embodiments, operation technologies, and the like that are implemented based on the embodiment by those skilled in the art or the like all fall within the scope of the present invention.

REFERENCE SIGNS LIST

11, 11P enhancement processing apparatus
12, 12A GEDI speech intelligibility calculating apparatus
12P speech intelligibility calculating apparatus
121 dynamic compressive gammachirp filter bank
122 amplitude envelope signal extracting unit
123 distortion signal extracting unit
124 modulation spectrum calculating unit
125, 125A modulation filter bank
126, 126A $SDR_{env}$ calculating unit
127 sensitivity index converting unit
128 speech intelligibility converting unit
129 speech intelligibility output unit

The invention claimed is:

1. A speech intelligibility calculating method executed by a speech intelligibility calculating apparatus including processing circuitry, the speech intelligibility calculating method comprising:

calculating speech intelligibility, with the processing circuitry, by finding a feature of an input clean speech and a feature of an input enhanced speech using a plurality of filter banks, and calculating a speech intelligibility that is an objective assessment index of a speech quality, based on a difference component between the found feature of the input clean speech and the feature of the input enhanced speech, finding a temporal distortion signal based on the feature of the clean speech and the feature of the enhanced speech, and calculating a signal-to-distortion ratio (SDR) of the clean speech and the temporal distortion signal based on the temporal distortion signal and the clean speech; and outputting, by the processing circuitry, the speech intelligibility calculated by the speech intelligibility calculating, wherein the calculating includes:

inputting the clean speech and the enhanced speech to a first filter bank where speeches are divided into sub-bands, and obtaining a time signal of each sub-band corresponding to the clean speech and a time signal of each sub-band corresponding to the enhanced speech that are output from the first filter bank;

calculating a temporal amplitude envelope signal of the clean speech and a temporal amplitude envelope signal of the enhanced speech based on the time signal of each sub-band, corresponding to the clean speech and the time signal of each sub-band corresponding to the enhanced speech;

finding a temporal distortion signal based on a difference between the temporal amplitude envelope signal of the clean speech and the temporal amplitude envelope signal of the enhanced speech;

inputting the temporal amplitude envelope signal of the clean speech, the temporal amplitude envelope signal of the enhanced speech, and the temporal distortion signal to a second filter bank, and obtaining a modulation power spectrum corresponding to the clean speech and a modulation power spectrum corresponding to the distortion signal that are output from the second filter bank; and calculating a signal-to-distortion ratio (SDR) between the clean speech and the distortion signal, as the difference component, based on the modulation power spectrum corresponding to the clean speech and the modulation power spectrum corresponding to the distortion signal.

2. The speech intelligibility calculating method according to claim 1, wherein the first filter bank is a dynamic compressive gammachirp filter bank.

3. The speech intelligibility calculating method according to claim 1, wherein the second filter bank is a band-pass filter bank in a modulation frequency domain.

4. A speech intelligibility calculating method executed b a speech intelligibilit calculating apparatus including rocessing circuitry, the speech intelligibility calculating method comprising:

calculating speech intelligibility, with the processing circuitry, by finding a feature of an input clean speech and a feature of an input enhanced speech using a pluralit of filter banks, and calculating a speech intelligibility that is an objective assessment index of a speech quality, based on a difference component between the found feature of the input clean speech and the feature of the input enhanced speech, finding a temporal distortion signal based on the feature of the clean speech and the feature of the enhance speer; and calculating a signal-to-distortion ratio (SDR) of the clean speech and the temporal distortion signal based on the temporal distortion signal and the clean speech; and outputting,by the processing circuitry, the speech intelligibilit calculated b the speech intelligibility calculating, wherein the calculating includes:

inputting the clean speech and the enhanced speech to a first filter bank where speeches are divided into sub-bands, and obtaining a time signal of each sub-band corresponding to the clean speech and a time signal of each sub-band corresponding to the enhanced speech that are output from the first filter bank;

calculating a temporal amplitude envelope signal of the clean speech and a temporal amplitude envelope signal of the enhanced speech based on the time signal of each sub-band corresponding to the clean speech and the time signal of each sub-band corresponding to the enhanced speech;

finding a temporal distortion signal based on a difference between the temporal amplitude envelope signal of the clean speech and the temporal amplitude envelope signal of the enhanced speech;

applying Fourier transform to the temporal amplitude envelope signal of the clean speech and to the temporal distortion signal to calculate a modulation power spectrum corresponding to the temporal amplitude envelope signal and a modulation power spectrum corresponding to the temporal distortion signal;

weighting the modulation power spectrum of the clean speech and the modulation power spectrum of the distortion signal, using a second filter bank; and calculating a signal-to-distortion ratio (SDR) between the weighted clean speech and the, weighted distortion signal, as the difference component.

5. The speech intelligibility calculating method according to claim 4, wherein the first filter bank is a dynamic compressive gammachirp filter bank.

6. The speech intelligibility calculating method according to claim 4, wherein the second filter bank is a band-pass filter bank in a modulation frequency domain.

7. A speech intelligibility calculating apparatus comprising:

a memory; and processing circuitry coupled to the memory, the processing circuitry configured to:

first find a feature of an input clean speech and a feature of an input enhanced speech using a plurality of filter banks, and calculate a speech intelligibility that is an objective assessment index of a speech quality, based on a difference component between the found feature of the input clean speech and the feature of the input enhanced speech, find a temporal distortion signal based on the feature of the clean speech and the feature of the enhanced speech, and calculate a signal-to-distortion ratio (SDR) of the clean speech and the temporal distortion signal based on the temporal distortion signal and the clean speech;

output the calculated speech intelligibility;

input the clean speech and the enhanced speech to a first filter bank where speeches are divided into sub-bands, and obtain a time signal of each sub-band corresponding to the clean speech and a time signal of each sub-band corresponding to the enhanced speech that are output from the first filter bank;

calculate a temporal amplitude envelope signal of the clean speech and a temporal amplitude envelope signal of the enhanced speech based on the time signal of each sub-band corresponding to the clean speech and the time signal of each sub-band corresponding to the enhanced speech;

find a temporal distortion signal based on a difference between the temporal amplitude envelope signal of the clean speech and the temporal amplitude envelope signal of the enhanced speech;

input the temporal amplitude envelope si nal of the clean speech, the temporal amplitude envelope signal of the enhance eec and the temporal distortion signal to a second filter bank, and obtain a modulation power spectrum corresponding to the clean speech and a modulation power spectrum corresponding to the distortion signal that are output from the second filter bank; and calculate a signal-to-distortion ratio (SDR) between the clean speech and the distortion signal, as the difference component, based on the modulation power spectrum corresponding to the clean speech and the modulation power spectrum corresponding to the distortion signal.

8. The speech intelligibility calculating apparatus according to claim 7, wherein the first filter bank is a dynamic compressive gammachirp filter bank.

9. The speech intelligibility calculating apparatus according to claim 7, wherein the second filter bank is a band-pass filter bank in a modulation frequency domain.

10. A speech intelligibility calculating apparatus comprising:

a memory; and processing circuitry coupled to the memory, the processing circuitry configured to:

calculate speech intelligibility by finding a feature of an input clean speech and a feature of an input enhanced speech using a plurality of filter banks, and calculate a speech intelligibility that is an objective assessment index of a speech quality, based on a difference component between the found feature of the input clean speech and the feature of the input enhanced speech, find a temporal distortion signal based on the feature of the clean speech and the feature of the enhanced speech, and calculate a signal-to-distortion ratio (SDR) of the clean speech and the temporal distortion signal based on the temporal distortion signal and the clean speech; and output the speech intelligibility calculated by the speech intelligibility calculating;

input the clean speech and the enhanced speech to a first filter bank where speeches are divided into sub-bands, and obtain a time signal of each sub-band corresponding to the clean speech and a time signal of each sub-band corresponding to the enhanced speech that are output from the first filter bank;

calculate a temporal amplitude envelope signal of the clean speech and a temporal amplitude envelope signal of the enhanced speech based on the time signal of each sub-band corresponding to the clean speech and the time signal of each sub-band corresponding to the enhanced speech;

find a temporal distortion signal based on a difference between the temporal amplitude envelope signal of the clean speech and the temporal amplitude envelope signal of the enhanced speech;

apply Fourier transform to the temporal amplitude envelope signal of the clean speech and to the temporal distortion signal to calculate a modulation power spectrum corresponding to the temporal amplitude envelope signal and a modulation power spectrum corresponding to the tern poral distortion signal;

weight the modulation power spectrum of the clean speech and the modulation power spectrum of the distortion signal, using a second filter bank; and calculate a signal-to-distortion ratio (SDR) between the weighted clean speech and the weighted distortion signal, as the difference component.

11. The speech intelligibility calculating apparatus according to claim 10, wherein the first filter bank is a dynamic compressive gammachirp filter bank.

12. The speech intelligibility calculating apparatus according to claim 10, wherein the second filter bank is a band-pass filter bank in a modulation frequency domain.

13. A non-transitory computer-readable storage medium storing thereon a speech intelligibility calculating program for causing a computer to execute a process comprising:

calculating speech intelligibility by finding a feature of an input dean speech and a feature of an input enhanced speech using a plurality of filter banks, and calculating a speech intelligibility that is an objective assessment index of a speech quality, based on a difference component between the found feature of the input clean speech and the feature of the input enhanced speech, finding a temporal distortion signal based on the feature of the clean speech and the feature of the enhanced speech, and calculating a signal-to-distortion ratio (SDR) of the clean speech and the temporal distortion signal based on the temporal distortion signal and the clean speech;

outputting the calculated speech intelligibility, wherein the calculating includes:

inputting the clean speech and the enhanced speech to a first filter bank where speeches are divided into sub-bands, and obtaining a time signal of each sub-band corresponding to the clean speech and a time signal of each sub-band corresponding to the enhanced speech that are output from the first filter bank;

calculating a temporal amplitude envelope signal of the clean speech and a temporal amplitude envelope signal of the enhanced speech based on the time signal of each sub-band corresponding to the clean speech and the time signal of each sub-band corresponding to the enhanced speech;

finding a temporal distortion signal based on a difference between the temporal amplitude envelope signal of the clean speech and the temporal amplitude envelope signal of the enhanced speech;

inputting the temporal amplitude envelope signal of the clean speech, the temporal amplitude envelope signal of the enhanced speech, and the temporal distortion signal to a second filter bank, and obtaining a modulation power spectrum corresponding to the clean speech and a modulation power spectrum corresponding to the distortion signal that are output from the second filter bank; and calculating a signal-to-distortion ratio (SDR) between the clean speech and the distortion signal, as the difference component, based on the modulation power spectrum corresponding to the clean speech and the modulation power spectrum corresponding to the distortion signal.

14. A non-transitory computer-readable storage medium storing thereon a speech intelligibility calculating program for causing a computer to execute a process comprising:

calculating speech intelligibility by finding a feature of an input clean speech and a feature of an input enhanced speech using a plurality of filter banks, and calculating a speech intelligibility that is an objective assessment index of a speech quality, based on a difference component between the found feature of the input clean speech and the feature of the input enhanced speech, finding a temporal distortion signal based on the feature of the clean speech and the feature of the enhanced speech, and calculating a signal-to-distortion ratio (SDR) of the clean speech and the temporal distortion signal based on the temporal distortion signal and the clean speech; and outputting the speech intelligibility calculated by the speech intelligibility calculating, wherein the calculating includes:

inputting the clean speech and the enhanced speech to a first filter bank where speeches are divided into sub-bands, and obtaining a time signal of each sub-band corresponding to the clean speech and a time signal of each sub-band corresponding to the enhanced speech that are output from the first filter bank;

calculating a temporal amplitude envelope signal of the clean speech and a temporal amplitude envelope signal of the enhanced speech based on the time signal of each sub-band corresponding to the clean speech and the time signal of each sub-band corresponding to the enhanced speech;

finding a temporal distortion signal based on a difference between the temporal amplitude envelope signal of the clean speech and the temporal amplitude envelope signal of the enhanced speech;

applying Fourier transform to the temporal amplitude envelope signal of the clean speech and to the temporal distortion signal to calculate a modulation power spectrum corresponding to the temporal amplitude envelope signal and a modulation power spectrum corresponding to the temporal distortion signal;

weighting the modulation power spectrum of the clean speech and the modulation power spectrum of the distortion signal, using a second filter bank; and calculating a signal-to-distortion ratio (SDR) between the weighted clean speech and the weighted distortion signal, as the difference component.

* * * * *